US005964600A

United States Patent [19]

Miles et al.

[11] Patent Number: 5,964,600

[45] Date of Patent: Oct. 12, 1999

[54] SHUTTERED ELECTRICAL CONNECTOR

[75] Inventors: Scott Blagdon Miles, Ashby, Mass.; Howard Reynolds, Waterbury, Conn.

[73] Assignee: Molex Incorporated, Lisle, Ill.

[21] Appl. No.: 09/092,635

[22] Filed: Jun. 5, 1998

[51] Int. Cl.[6] ..... H01R 13/44

[52] U.S. Cl. ..... 439/140; 439/138

[58] Field of Search ..... 439/138, 137, 439/139, 140, 676

[56] References Cited

U.S. PATENT DOCUMENTS

| | | | |
|---|---|---|---|
| 4,624,516 | 11/1986 | White | 439/136 |
| 4,666,225 | 5/1987 | Hampton et al. | 439/140 |
| 4,713,016 | 12/1987 | Kato | 439/137 |
| 4,790,769 | 12/1988 | Kanada | 439/676 |
| 4,950,172 | 8/1990 | Anhalt et al. | 439/108 |
| 5,156,554 | 10/1992 | Rudoy et al. | 439/108 |
| 5,224,868 | 7/1993 | Tseng | 439/676 |
| 5,295,844 | 3/1994 | Koshikawa et al. | 439/138 |
| 5,399,106 | 3/1995 | Ferry | 439/620 |
| 5,409,401 | 4/1995 | Schaarschmidt et al. | 439/620 |
| 5,431,584 | 7/1995 | Ferry | 439/620 |
| 5,513,065 | 4/1996 | Caveney et al. | 361/311 |
| 5,580,270 | 12/1996 | Pantland et al. | 439/395 |
| 5,580,280 | 12/1996 | Minich et al. | 439/620 |
| 5,697,817 | 12/1997 | Bouchan et al. | 439/676 |

FOREIGN PATENT DOCUMENTS

| | | |
|---|---|---|
| 709930 | 5/1996 | European Pat. Off. . |
| 750370 | 12/1996 | European Pat. Off. . |
| 2 260 035 | 3/1993 | United Kingdom . |

*Primary Examiner*—Neil Abrams
*Assistant Examiner*—T C Patel
*Attorney, Agent, or Firm*—A. A. Tirva

[57] ABSTRACT

An electrical connector has a shutter arrangement which moves in the direction of plug insertion. The shutter has tabs which slide in grooves in the housing and grooves which pass over conductors in a plug receiving chamber. The shutter is moved to the back of the chamber when a plug is inserted and is biased by a spring to return to close the chamber when the plug is removed. The spring is formed of a pair of interconnected Z-shaped portion. On movement of the shutter in the direction of plug insertion, a free end of each portion moves in the shutter movement direction whereas an intermediate portion of each Z-shaped portion moves in a transverse direction.

18 Claims, 7 Drawing Sheets

SHUTTERED ELECTRICAL CONNECTOR

FIELD OF THE INVENTION

This invention relates to electrical connectors, and in particular to connectors for use in telecommunications systems.

BACKGROUND OF THE INVENTION

It is well known to provide shuttered electrical connectors. Typically, the connector includes an aperture for receiving a plug to establish electrical contact between conductors of the connector arranged in the aperture and conductors on the plug. The shutter is usually biased towards a closed position so that ingress of dust is avoided when the connector is not in use.

One well known type of shutter comprises a one piece plate which is spring biased and moves across the face of the aperture in a plane approximately normal to the direction of plug insertion. The shutter is arranged behind the face plate of the connector to retain it in position but has the disadvantage of imposing considerable size requirements on the connector as the connector housing must have sufficient room to accommodate the shutter when it moves away from the aperture to expose the aperture. One attempt to solve this problem has used a two part shutter in which one part slides over the other when the shutter is opened to reduce by half the room required to accommodate the shutter in its open position. Examples of the known prior art are shown in U.S. Pat. No. 4,624,516 and GB-A-2,260,035.

A more compact arrangement is disclosed in U.S. Pat. No. 4,666,225 assigned to Siecor Corporation. This document discloses a shutter which is folded into the plug receiving aperture of a socket as a plug is inserted. The shutter is biased to a normally closed position by a coil spring. The shutter is proved with a plurality of slots through which socket contacts protrude as the shutter is folded into the socket. This enables contacts on the plug to establish electrical contact with jack contacts which would otherwise be obstructed by the shutter.

We have appreciated that the design of U.S. Pat. No. 4,666,225 suffers from a fundamental fault. The spring arrangement required to balance the forces on a shutter of this type is such that at least the outer contacts in the socket are at risk of shorting out on the coil spring.

SUMMARY OF THE INVENTION

The present invention aims to utilize the space benefits of a shutter of the type of U.S. Pat. No. 4,666,225 but to overcome the problems of contacts shorting on the biasing spring.

In essence, this aim is achieved by a novel spring arrangement. The spring comprises a pair of Z shaped spring portions which are arranged one on each side of the shutter. The arrangement is such that on plug insertion a free end of each portion abutting the shutter moves in the direction of shutter insertion whilst an intermediate portion moves in a direction transverse to the direction of insertion. Preferably that transverse direction is away from the socket contacts.

This arrangement has the advantage that the forces on the shutter remain balanced, ensuring smooth opening and closing, and the further advantage that the spring material does not interfere with the conductors in the socket or the plug so avoiding the risk of shorting.

More specifically, there is provided a telecommunications connector, comprising:

a socket having a chamber having an open end for receiving a plug carrying a plurality of contacts, the socket having a plurality of conductors arranged in the chamber for establishing electrical contact with the plurality of contacts;

a shutter, the shutter being biased by a spring to a position in which the chamber is closed and moveable between the closed position and an open position in which a plug can be received in the chamber; and guide means for guiding the shutter into the chamber towards the open position and in the direction of plug insertion, whereby in the open position the shutter is received in the chamber at position remote from the open end of the chamber, characterized in that the spring comprises two pairs of spring portions arranged one on each side of the shutter, each spring portion being Z shaped having a first member abutting the shutter, a base member and an intermediate member arranged between the base member and the first member, wherein on insertion of a plug into the chamber, the intermediate member moves towards the base member and a free end of the first member moves in the direction of plug insertion.

The invention also provides a telecommunications connector, comprising a socket having a chamber with an open end for receiving a plug carrying a plurality of contacts, the socket having a plurality of elongate wire conductors arranged in the chamber for establishing electrical contact with the plurality of contacts; and a spring biased shutter moveable in the chamber in the direction of insertion or retraction of a plug, between a closed position in which the shutter blocks the open end of the chamber, and an open position in which the shutter is received in the chamber at a position remote from the open end; wherein, the shutter comprises a plurality of grooves along a side thereof, the grooves being spaced each to receive a wire conductor mounted in the chamber as the shutter moves between the closed and open positions, and wherein, the spring comprises a pair of interconnected Z-shaped portions, a free end of each portion abutting the shutter and moving in the direction of plug insertion and an intermediate portion of each portion moving in a direction transverse to the direction of plug insertion.

The invention further provides a telecommunications connector, comprising a socket having a chamber with an open end for receiving a plug carrying a plurality of contacts, the socket having a plurality of conductors arranged in the chamber for establishing electrical contact with the plurality of contacts; and a shutter moveable against the bias of a spring in the chamber in the direction of insertion or removal of a plug, between a closed position in which the shutter blocks the open end of the chamber, and an open position in which the shutter is received in the chamber at a position remote from the open end, characterized in that the spring comprises a pair of z-shaped spring portions each portion having a first member abutting the shutter, an intermediate member and a base member, wherein on insertion of a plug, the end of the first member abutting the shutter moves in the direction of plug insertion and the intermediate member moves towards the base member.

The spring arrangement embodying the invention allows connector space to be reduced as no space is required for the shutter beside the aperture in the open position. This is because the shutter in that position is received at the bottom of the chamber, moving in the direction of insertion or withdrawal rather than transverse to that direction.

Preferably, the guide means comprises grooves and tabs slidable in the grooves. It is especially preferred that the grooves are in walls defining the chamber and that the tabs, or runners, are provided on the shutter. This arrangement is more simple to manufacture. It is further preferred that the tabs are elongate to assist smooth running of the shutter in the grooves and to eliminate any tendency for the shutter to twist rather than slide in the direction of plug insertion.

Preferably, a side of the shutter carries a plurality of grooves. The grooves are preferably equal in number a spacing to the number and spacing of the conductors in the chamber so that the shutter can slide over those grooves without interference with the conductors.

In an alternative embodiment the conductors could be arranged to deform resiliently into grooves in the chamber as the shutter is moved removing the need for grooves in the shutter.

Embodiments of the invention have the further advantage that they are easy and cheap to manufacture and may reduce component cost. The invention may be used with any telecommunications connector in which a sliding shutter is presently used and is particularly suited to RJ 45 type shuttered sockets.

BRIEF DESCRIPTION OF THE DRAWINGS

An embodiment of the invention will now be described, by way of example only, and with reference to the accompanying drawings in which.

DETAILED DESCRIPTION OF THE PREFERRED EMBODIMENT

Figure 1:
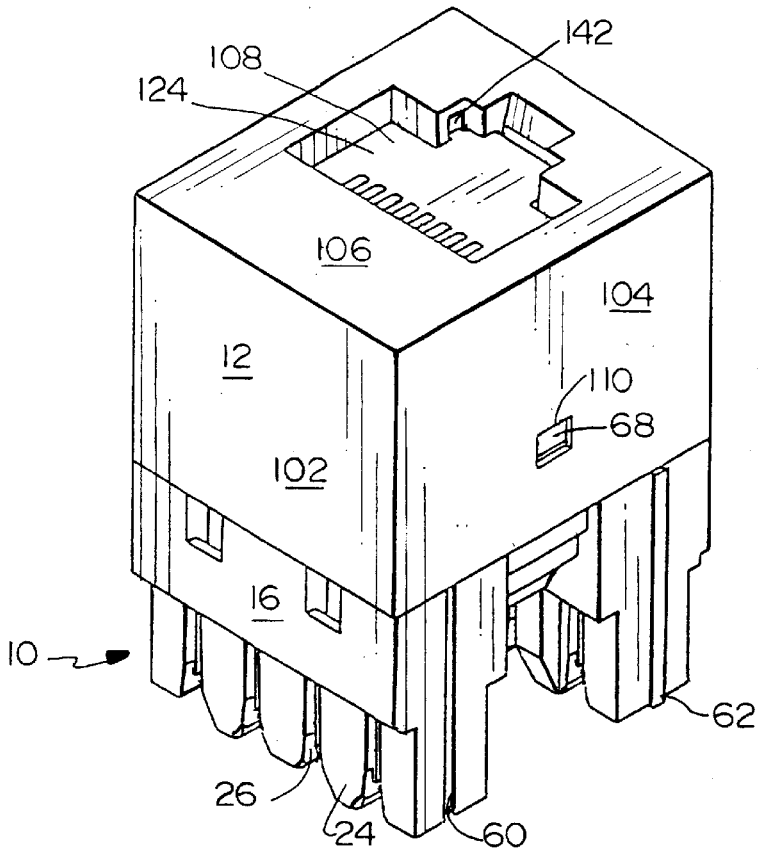
FIG. 1 is a perspective view of an assembled connector embodying the invention.
Figure 10:
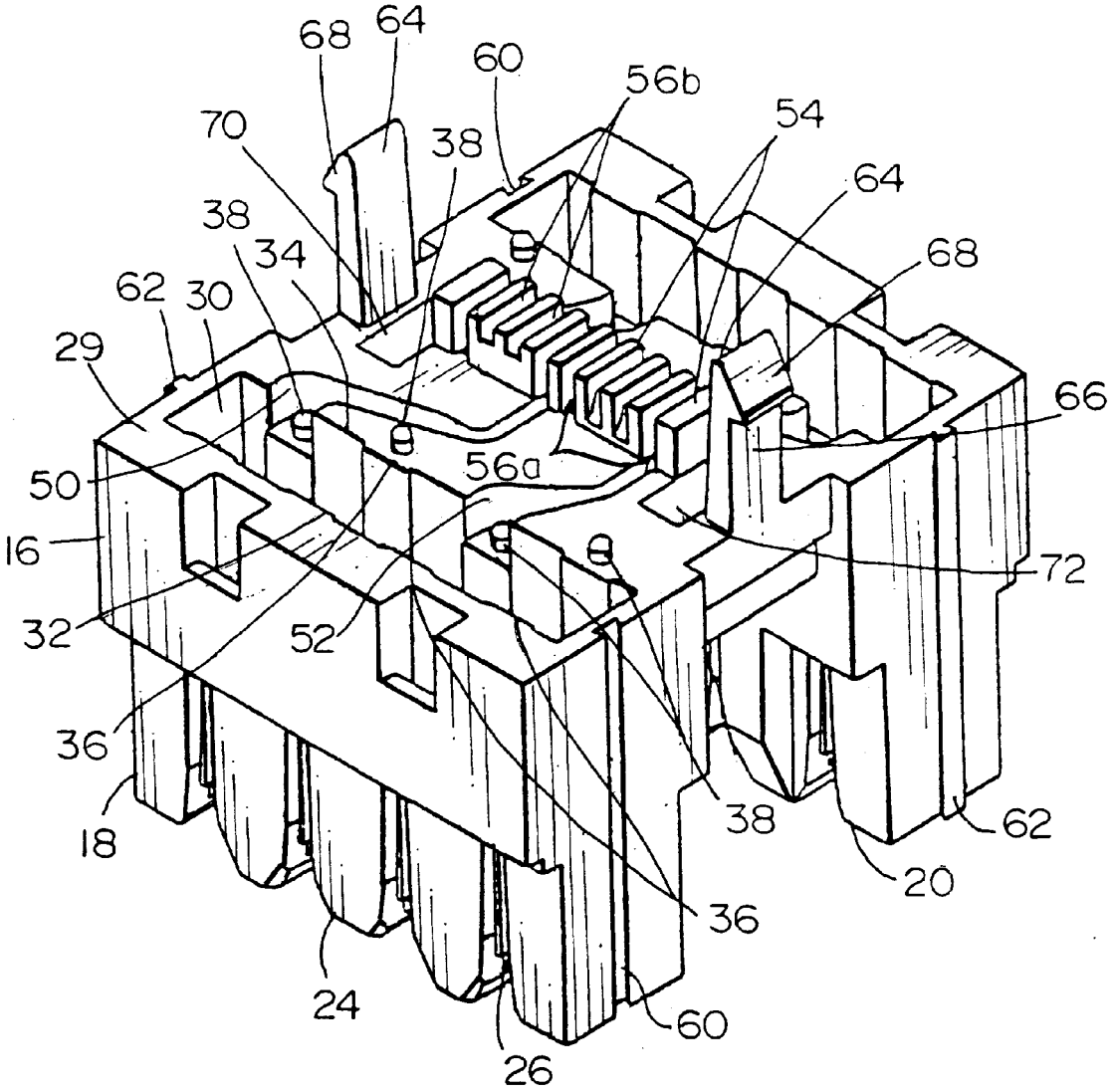
FIG. 10 is a perspective view of a rear body of the connector of FIG. 1.

The connector 10 of FIG. 1 has three main body parts: a front body 12 (FIG. 2), an intermediate body 14 (FIG. 7) and a rear body 16 (FIG. 10). The connector is of the general type known as the RJ style connector in which a contact carrying plug makes electrical contact with a number of conductors arranged in a plug receiving aperture. The conductors terminate at their opposite ends in insulation displacement contacts for establishing electrical contact with a remote location.

Figure 6:
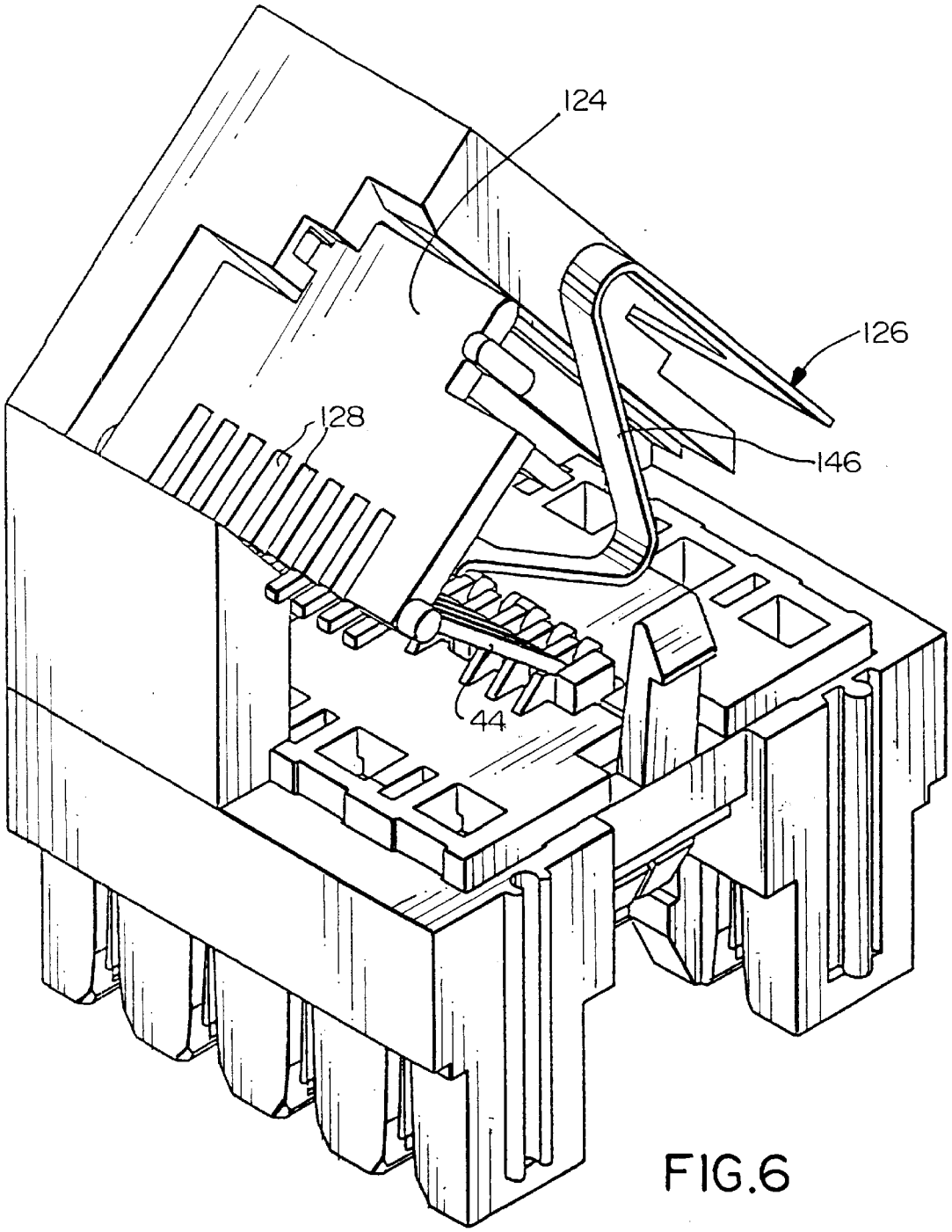
FIG. 6 is a perspective partial cut-away view of an angled connector embodying the invention.

The rear connector body shown in FIG. 10 comprises a pair of rows of housings 18,20 for insulation displacement contacts 22 shown in FIG. 6. The contact design and arrangement in the housing is fully described in our international application WO92/22941 and 96/09663 the contents of which are hereby incorporated by reference.

Figure 8:
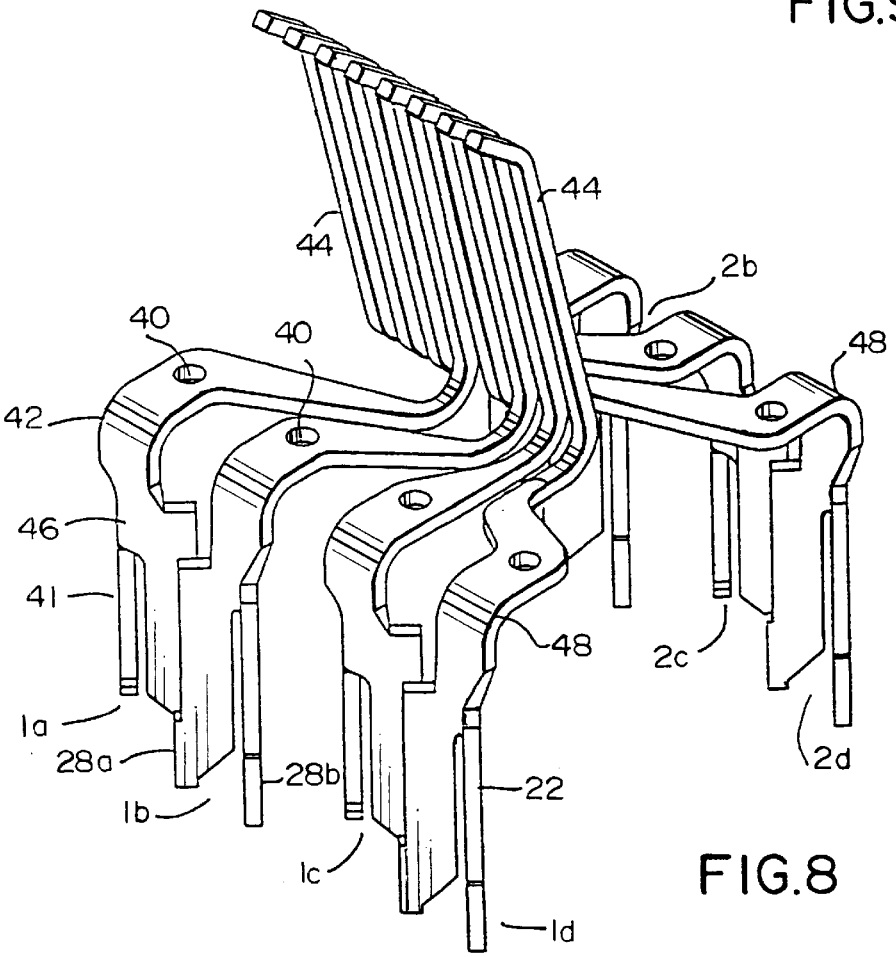
FIG. 8 is a perspective view of a contact set of the connector of FIG. 1.

Adjacent teeth 24 of the insulation displacement connector housings receive wires between them in slots 26. When the contacts are mounted in position, insertion of a wire into a slot forces the wire between the tines 28*a,b* of a contact so cutting the insulation on the wire and establishing electrical contact between the wire and the contact. The teeth 24 are each partially hollow to receive the insulation displacement contacts and the underside 29 of the rear body 16 carries an elongate slot 30 above each of the rows of insulation displacement connector (IDC) housing into which the contacts can be inserted. In the arrangement shown in FIG. 10, four contacts are received in each row 18, 20. The elongate slot 30 has, or each of its long sides 32, 34, raised strips 36 arranged opposite one another in pairs to assist in retaining the insulation displacement contacts in position. On the underside of the rear body, adjacent the innermost slot wall, are four locating pegs 38 which cooperate with locating apertures 40 in the respective contacts (FIG. 8). The combination of the apertures 40 and pegs 38 further assist in retaining the contacts in position on the rear body.

The pegs could, alternatively be arranged on the contacts and the apertures replaced by depressions on the surfaces of the underside 29 of the rear body.

Similarly, the type of insulation displacement connector used is not critical. The preferred contact type is that described in WO96/09663 and sold by Mod-Tap Corp of Harvard, Mass., under the trade mark KATT (RTM). In accordance with the teaching of WO92/22941 the contacts in FIG. 8 are disposed alternately to extend on opposite sides of the center axis of the slot. Thus contacts a) and b) extend to one side of the center axis and contacts c) and d) extend to the other side. This arrangement is only desirable if a folded V-type contact is used.

As can be seen from FIG. 8 the conductors 41 each comprise three sections: the insulation displacement portion 22, an intermediate portion 42 and a tail portion 44.

The insulation displacement portion 22 comprises the pair of tines 28*a,b* which define a cutting slot for receipt of insulated wires. The tines in this embodiment are of the folded V type having an internal angle of approximately 90. At the base of the tines is a neck 46. The intermediate portion of the contact gradually tapers towards the tail portion and includes the locating aperture described previously. In addition, the contact turns through approximately 90 at shoulder 48. As can be seen, the exact configuration of each intermediate portion is different. This difference is due to the need to manage crosstalk and will be discussed in detail later on.

Referring back to FIG. 10 it will be seen that the underside 29 of the rear connector includes a pair of channels 50, 52 which receive, respectively the intermediate portions of conductors a) and b) in FIG. 8.

It will be appreciated that the remaining two intermediate portions, of conductors c) and d) sit on the underside of the contact above the level of the intermediate portions of conductors a) and b). A similar arrangement is provided for both rows of conductors.

In the center of the underside 29 of the rear connector 16 is a row of nine short, parallel, walls 54 which define slots 56 therebetween. Four of the slots 56*a* are relatively deep and the remaining four slots 56*b* are relatively shallow. The slots are arranged such that the two outer slots and the two innermost slots are the relatively deep slots. The relatively deep slots 56*a* run into the channels 50, 52 to receive two of the conductors. As can be seen from FIG. 10, one of the channels terminates to one of the outer slots and the other channel terminates to the innermost slot furthest from that outer slot.

Considering now the arrangement of the conductors shown in FIG. 8 and the arrangement of slots described, and adopting a slot numbering starting with 1 on the far right hand side the conductors are arranged as follows:

8 7 6 5 4 3 2 1

D S S D D S S D

2*a* 2*b* 2*c* 1*a* 2*d* 1*b* 1*c* 1*d*

Where S is a relatively shallow slot and D is a relatively deep slot.

Viewing the conductors as a whole, it will be appreciated that the tail portions of the conductors are cantilevered from the rear of the connector rather than the front as practiced in the prior art. This has the advantage of reducing the amount of material required to form the contacts and also reduces the length of the parallel tail portions within the connector which may give rise to crosstalk, or be used to correct for crosstalk. In the embodiment shown, crosstalk correction is applied by the arrangement of the rearward facing insulation displacement contacts and their respective portions. The spacings maybe varied to change the capacitance between them thereby correcting crosstalk without the need for the long parallel portions of conductor required in the prior art.

Additional compensation may be applied by the provision of larger or smaller tine areas on the IDC contacts to modify the capacitance, or by the addition of plate areas to the contacts at their base, arranged to overlap similar plate areas on other contacts.

Referring again to FIG. 10, the rear housing further includes a slot 60 having a trapezoidal cross-section and extending the length of one end wall of each IDC housing row. The other end wall has a corresponding key allowing connectors to the joined by insertion of the keys into the slots.

The underside of the rear connector 16 further includes a pair of snap connectors 64 arranged at the center of the underside and extending away from the IDC housings. The snap connectors are conventional, each comprising an upstanding limb 66 having a tooth 68 on its outer face.

The snap connectors 64 connect the rear body 16 to the front body 12 as will be described. Located between the snap connectors and the outermost walls 54 is a pair of slots 70, 72 which receive snap connectors located on the intermediate body for connection to the rear body to the intermediate body.

Figure 7:
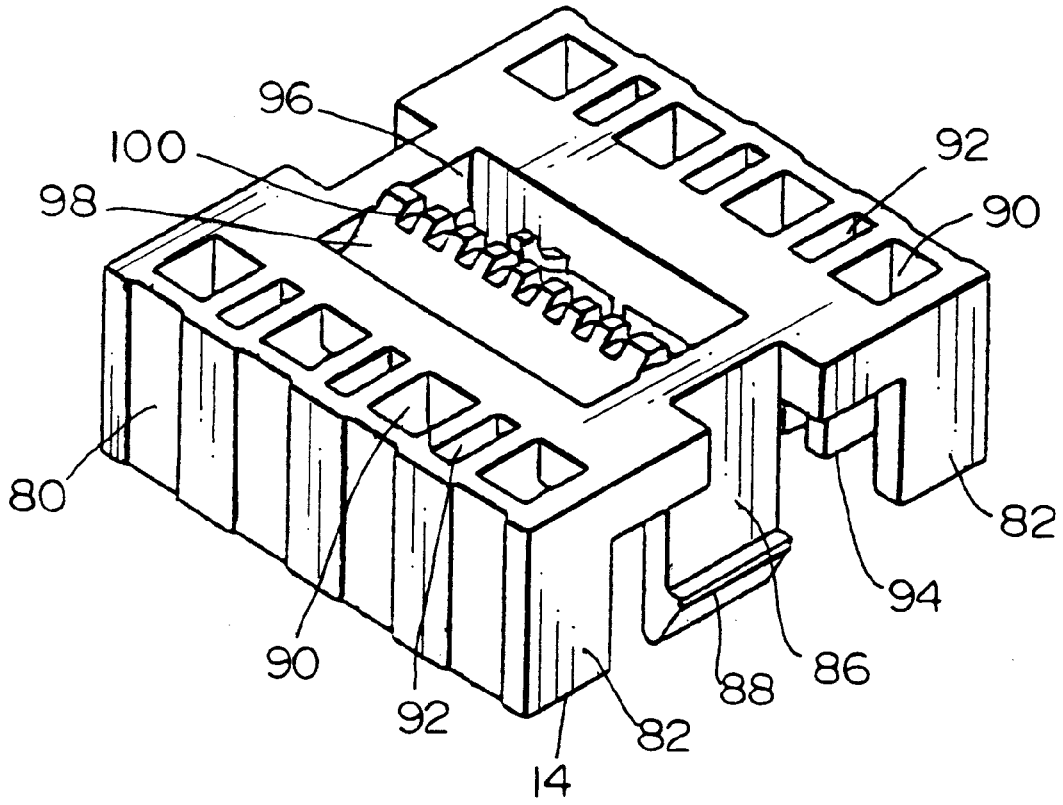
FIG. 7 is a perspective view of an intermediate body of the connector of FIG. 1.
Figure 9:
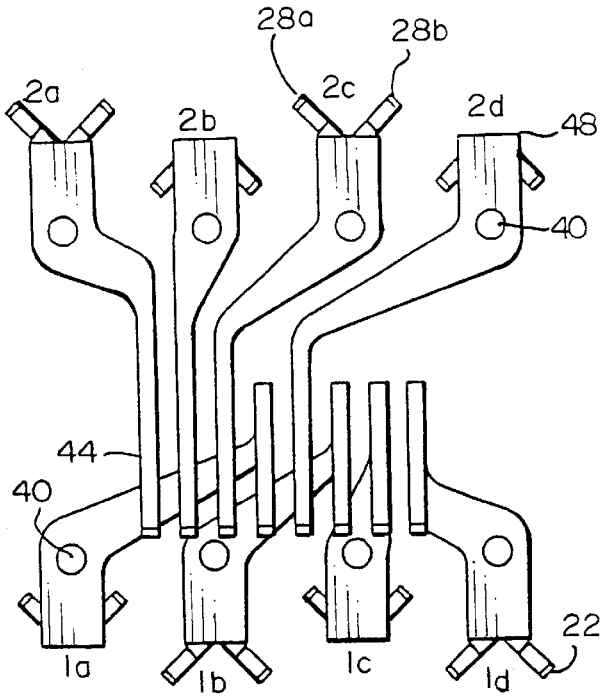
FIG. 9 is a plan of the contact arrangement of FIG. 8.

Turning to FIG. 7, the intermediate body has, along two sides, a depending wall 80 having end portions 82 equal in width to the width of the slots 30 of the rear body. The walls 80 have grooves 84 corresponding to the grooves as the inner surfaces of the slots 30. The intermediate body 14 is received in the rear body 16 by slotting the side walls and end portions 80, 82 into the slots 30. Depending snap connectors 86 in the middle of the intermediate body (one only shown in FIG. 7) pass through slots 70, 72 in the rear body such that teeth 88 on the intermediate body snap connector latch on the rear face of the rear body.

Two rows of apertures are provided on the intermediate connector. Each comprises four approximately square apertures 90 and three rectangular apertures 92. The apertures are bounded by depending internal walls 94 which are just visible on the right hand side of the figure and which extend transverse to side walls 80 and the square apertures and internal walls combined to form housings for the lower portions of the insulation displacement portions 22 of the conductors adjacent the intermediate portions.

In the center of the intermediate body is a rectangular aperture 96 having an angled wall 98 extending upwards and on its free side towards the center of the aperture having eight evenly spaced slots 100. Although not visible in FIG. 7 the slots 100 are the ends of parallel grooves which extend into the aperture in which lie portions of the tail portions of the conductors adjacent the intermediate portions.

Figure 2:
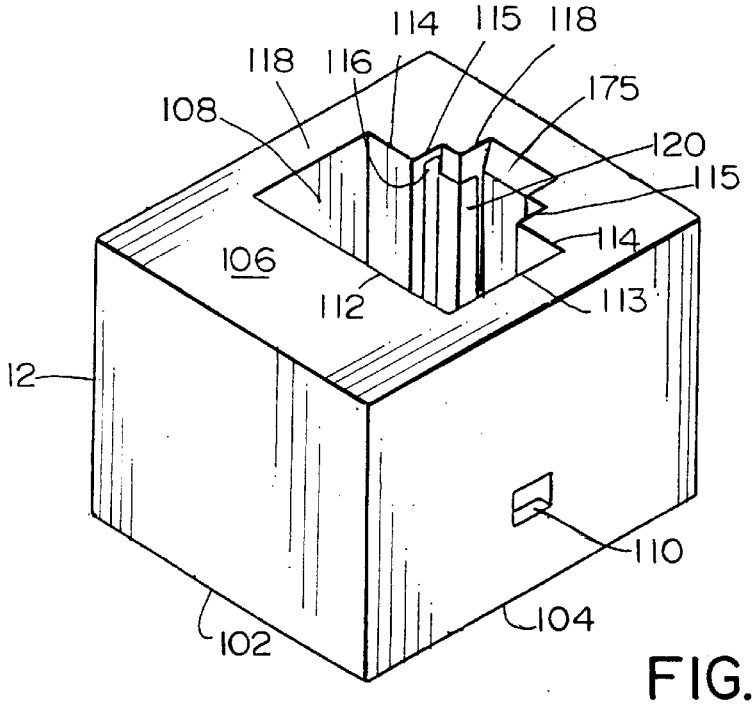
FIG. 2 is a perspective view of the front body of the connector of FIG. 1.

Turning now to FIG. 2, the front body 12 comprises a rectangular body having four side walls 102, 104 and an upper surface 106 having an aperture 108. The underside (not shown) is open. On two opposing side walls 104 an aperture 110 is provided to receive the tongue 68 of a respective snap connector 64 of the rear body to connect the front and rear bodies together.

The aperture 108 in the upper surface is shaped to receive a standard RJ type plug. It will be appreciated from FIG. 2 that walls depend from the sides of the aperture to define an internal chamber 175. It will also be appreciated that the tail portions of the conductors extend into that chamber 110 resting on the side wall depending from the centermost side 112 of the aperture.

The aperture 108 and chamber 175 comprise a main rectangular portion bounded by the side 112 and by two opposite sides 113. The fourth side is provided partly by a pair of walls 114 and is partly open forming a second narrow rectangular portion having a width less than that of the main portion. A third still narrower portion is continuous with a portion of one side of the second portion opposite the main portion.

The second rectangular portion has side walls 115 in which rectangular grooves 116 extend the length of the walls 115. Similarly side walls 118 of the third portion have grooves 120 extending the length of those walls. The grooves 120 are open on the side adjacent the second rectangular portion such that walls 122 which form part of one side of the portion terminate after a short distance at the start of the groove so that the groove is effectively a cut away with the portion of the upper surface bounded by walls 118 and 122 acting as an upper stop.

Figure 3:
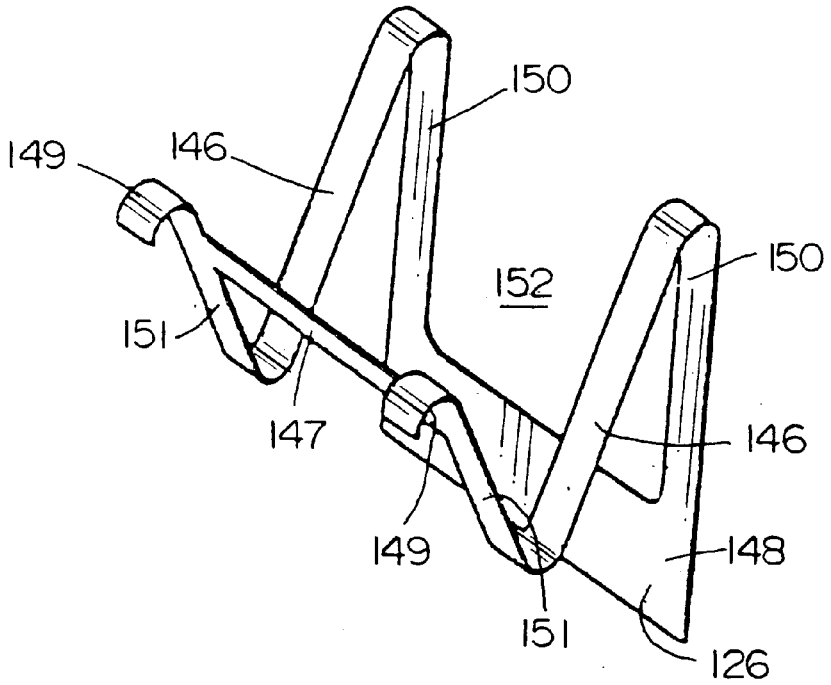
FIG. 3 is a perspective view of a shutter return spring of the connector of FIG. 1 and embodying the invention.
Figure 4:
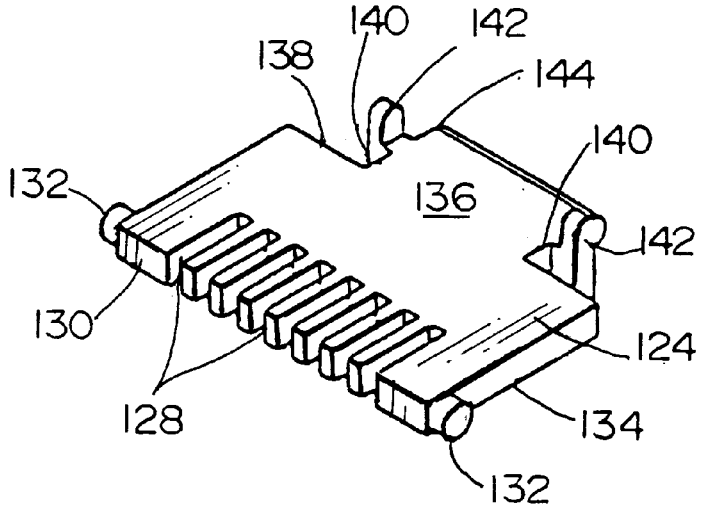
FIG. 4 is a perspective view of a shutter of the connector of FIG. 1.

Referring to FIGS. 1 and 3 and 4 it can be seen that a shutter 124 is arranged in the aperture 108. The shutter is biased by a spring 126 towards the closed position shown in FIG. 1. However, to open the shutter, rather than moving the shutter in a plane transverse to the direction of plug insertion, the shutter is pushed into the aperture moving in the same direction as the direction of plug insertion and the shutter remains generally parallel to the upper surface 106 of the front body as it moves into the chamber.

The manner in which this is achieved can be understood from FIGS. 3 and 4 in conjunction with FIG. 2. The shutter 12 is generally rectangular having a series of eight closely spaced slots 128 along one of its major sides 130. The spacing of these slots corresponds to the spacing of the tail portions 44 of the conductors so that the shutter can slide over the conductors as it slides into the plug chamber. Although not visible in the figures, the wall of the chamber depending from side 112 of the aperture carries grooves in which the tail portions sit. The slots 128 in the side 130 of the shutter are sufficiently deep to allow the shutter to pass over the grooves. A pair of pins 132 are provided as the minor sides 134 of the shutter adjacent the grooved side 124. These pins slide in the grooves in the corresponding side walls 113 of the chamber (not shown).

A second, smaller rectangular portion 136 extends from the major side 138 opposite the slotted side 130. The short sides 140 of the second rectangular portion 136 each have a longitudinal tab 142 extending above and below the shutter. These tabs are received in the grooves 116 in the side walls 115 of the chamber. The elongate nature of the tabs enables the shutter to slide easily in the grooves. As can be seen from FIGS. 1 and 2, the end corners 144 of the second portion 136 are received under the side walls 118, 122 of the chamber limiting forward movement of the shutter.

Figure 5:
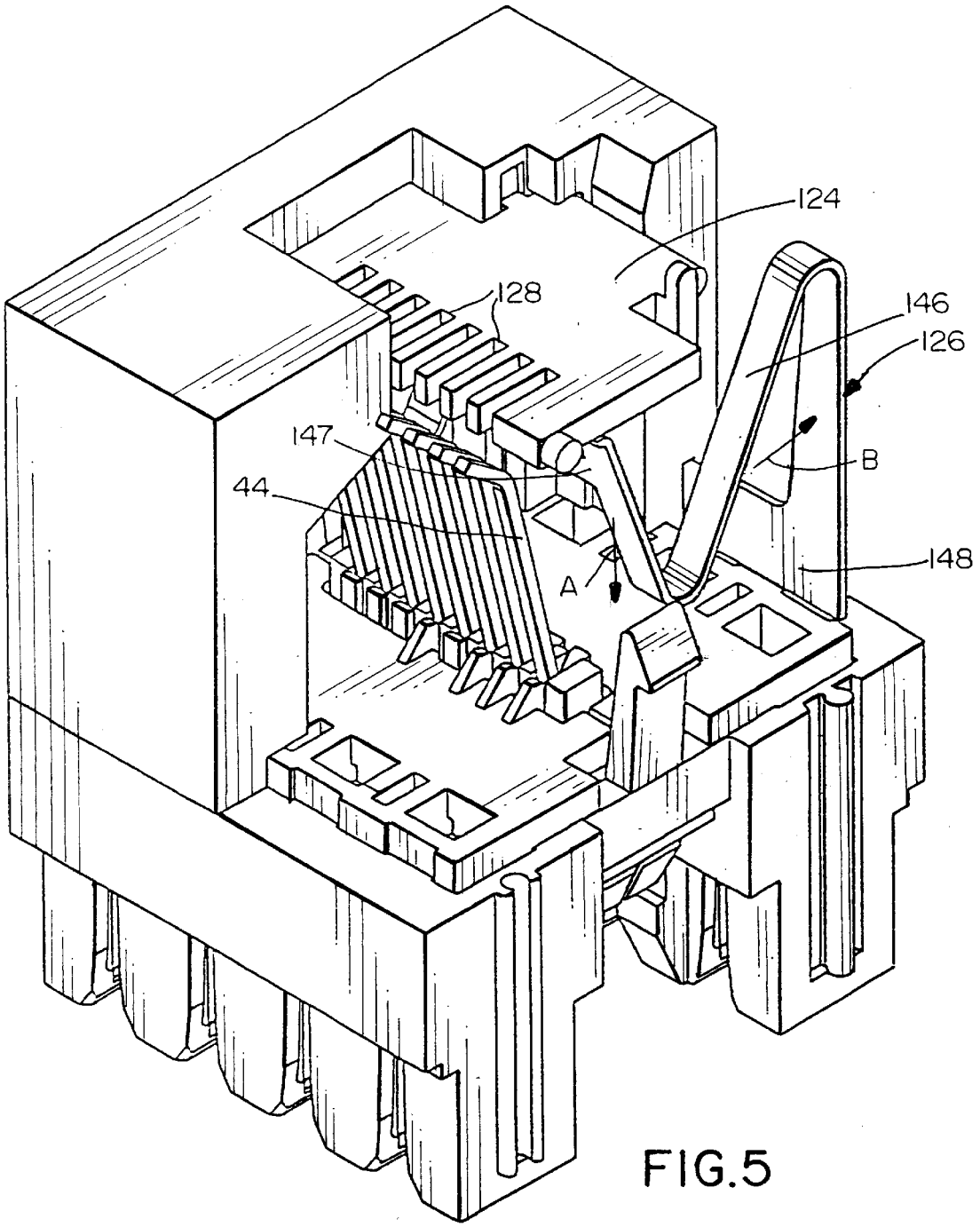
FIG. 5 is a perspective partial cut-away view of a connector embodying the invention.

Turning to FIGS. 3, 5 and 6 the spring 126 comprises two outwardly biased Z shaped portions 146 connected by a link bar 147 at their one ends and each having at that end a curved end portion 149 which sits in a transverse groove (not shown) in the underside of the shutter. The elongate bases 150 of the Z shaped portions are connected by an elongate intermediate portion 148 to form a rectangular base portion. The intermediate portion 148 and the bases 150 define an aperture 152.

As can be seen from FIGS. 5 and 6, the spring is mounted to the side of the aperture by insertion of the elongate bases and the intermediate portion 148 within grooves in the housing. On application of pressure to the shutter in the direction "A" of plug insertion intermediate limbs 146 of the Z-shaped portions to move in direction "B" towards the rectangular base portion formed by the base members 150 and the intermediate base member 148, and causes the other limbs 151 of the Z-shaped portions, interconnected by bar 147, to move downwards in the direction of insertion of the plug. The resilience of the spring together with the location of the ends 149 of the spring in the grooves on the underside of the shutter ensures that the distance between the free ends of the V portions and the rectangular portions remains constant. When the pressure on the shutter is released, for example the plug is removed, the resilience of the spring will force the shutter back to the normally closed position shown in FIG. 1. The free end of the Z-shaped portions will again follow the direction of plug movement.

It will be appreciated that as a plug is inserted, the intermediate portion 146 of the spring is in compression whereas the free end 151 is in tension. It will be appreciated from FIGS. 5 and 6 that the spring will always remain clear of the socket contacts as the shutter moves within the socket aperture. This eliminates the risk of shorting any of the contacts.

FIG. 6 differs from FIG. 5 only in that it shows an angled connector. In this embodiment the spring is mounted, and functions in exactly the same manner although it will be noted that the socket connectors are angled further towards the front of the connector.

The spring arrangement described ensures that the forces on the shutter are balanced allowing the shutter to move up and down smoothly without sticking and without becoming jammed. In addition, the design is such that there is no possibility of the contacts shorting on the spring.

The link bar 147 is useful as it provides rigidity and ensures that there are equal forces on the two sides of the shutter. However it will be appreciated that it could be omitted, although it may prove difficult to open and close the shutter smoothly and it could become locked.

Similarly the intermediate member 148 on the base could be dispensed with leaving, at its most basic two separate spaced apart V-shaped spring portions. These would include the side members 150.

Thus it will be seen that the shutter arrangement described has a zero footprint. That is, the shutter does not occupy any space transverse to the plug chamber even when the plug is inserted. This is advantageous as it saves space. In the embodiment described it will be appreciated that the size of the conductor is dictated by the number of IDCs it is required to carry.

It will be appreciated by those skilled in the art that modifications and variations to the embodiment described are possible without departing from the spirit and scope of the invention. It is important to appreciate that the shutter arrangement of the front body is wholly independent of the IDC arrangement of the rear and intermediate bodies. The shutter arrangement may be used with any connector whether or not it terminates to an insulation displacement connector of any type. For example it could be used in a standard shuttered wall socket to shutter an RJ 45 socket.

We claim:

1. A telecommunications connector, comprising:

a socket having a chamber having an open end for receiving a plug carrying a plurality of contacts, the socket having a plurality of conductors arranged in the chamber for establishing electrical contact with the plurality of contacts;

a shutter, the shutter being biased by a spring to a position in which the chamber is closed and moveable between the closed position and an open position in which the plug can be received in the chamber; and guide means for guiding the shutter into the chamber towards the open position and in the direction of plug insertion, whereby in the open position the shutter is received in the chamber at position remote from the open end of the chamber, wherein the spring comprises two pairs of spring portions arranged one on each side of the shutter, each spring portion being Z-shaped having a first member abutting the shutter, a base member and an intermediate member arranged between the base member and the first member, wherein on insertion of the plug into the chamber, the intermediate member moves towards the base member and a free end of the first member moves in the direction of plug insertion.

2. A telecommunications connector according to claim 1, wherein the guide means comprises grooves and tabs slidable in the grooves.

3. A telecommunications connector according to claim 2, wherein the grooves are provided in the walls of the socket defining the chamber and the tabs are arranged on the shutter.

4. A telecommunications connector according to claim 3, wherein a pair of grooves are provided on the socket walls and a pair of tabs are provided on the shutter.

5. A telecommunications connector according to claim 3, wherein the tabs are elongate.

6. A telecommunications connector according to claim 4, wherein the tabs are elongate.

7. A telecommunications connector according to claim 1, wherein a side of the shutter has a plurality of slots whereby on movement of the shutter into the chamber the conductors in the chamber are received in the slots.

8. A telecommunications connector according to claim 1, wherein the free ends of the first spring portions rest in one or more slots on the shutter.

9. A telecommunications connector according to claim 1, wherein the first portions of the Z-shaped spring portions are connected by a link member.

10. A telecommunications connector according to claim 9, wherein the link member is proximate the free ends of the first portions of the z-shaped portions.

11. A telecommunications connector according to claim 1, wherein the base portions of each Z-shaped portion are interconnected by a base linking member.

12. A telecommunications connector according to claim 1 wherein the pair of spring portions form a unitary spring.

13. A telecommunications connector according to claim 1, wherein the bases portions of the spring members are retained in slots in the chamber.

14. A telecommunications connector according to claim 11, wherein the base linking member is retained in a slot in the chamber.

15. A telecommunications connector according to claim 1, wherein, on insertion of a plug into the chamber, the first portion of each Z-shaped spring portion is in tension and the intermediate portion of each spring portion is in compression.

16. A telecommunications connector, comprising a socket having a chamber with an open end for receiving a plug carrying a plurality of contacts, the socket having a plurality of conductors arranged in the chamber for establishing electrical contact with the plurality of contacts; and a shutter moveable against the bias of a spring in the chamber in the direction of insertion or removal of the plug, between a closed position in which the shutter blocks the open end of the chamber, and an open position in which the shutter is received in the chamber at a position remote from the open end, characterized in that the spring comprises a pair of z-shaped spring portions each portion having a first member abutting the shutter, an intermediate member and a base member, wherein on insertion of the plug, the end of the first member abutting the shutter moves in the direction of plug insertion and the intermediate member moves towards the base member.

17. A telecommunications connector, comprising a socket having a chamber with an open end for receiving a plug carrying a plurality of contacts, the socket having a plurality of elongate wire conductors arranged in the chamber for establishing electrical contact with the plurality of contacts; and a spring biased shutter moveable in the chamber in the direction of insertion or retraction of the plug, between a closed position in which the shutter blocks the open end of the chamber, and an open position in which the shutter is received in the chamber at a position remote from the open end; wherein, the shutter comprises a plurality of grooves along a side thereof, the grooves being spaced each to receive a wire conductor mounted in the chamber as the shutter moves between the closed and open positions, and wherein, the spring comprises a pair of interconnected Z-shaped portions, a free end of each portion abutting the shutter and moving in the direction of plug insertion and an intermediate portion of each portion moving in a direction transverse to the direction of plug insertion.

18. A telecommunications connector according to claim 7, wherein the conductors in the chamber are elongate wire conductors and are equal in number and spacing to the number and spacing of the slots.

* * * * *